United States Patent [19]

Kleiner et al.

[11] Patent Number: 4,538,557

[45] Date of Patent: Sep. 3, 1985

[54] INTERNAL COMBUSTION ENGINE

[76] Inventors: Rudolph R. Kleiner, 11 First St., Old Bridge, N.J. 08857; Raymond W. Kleiner, 1074 Appache St., North Brunswick, N.J. 08902; Richard T. Bowie, Sr., 255B Oak St., Old Bridge, N.J. 08857

[21] Appl. No.: 478,477

[22] Filed: Mar. 24, 1983

[51] Int. Cl.[3] ..... F02B 75/04

[52] U.S. Cl. ..... 123/78 E; 123/48 B; 123/197 AC

[58] Field of Search ..... 123/78 E, 78 R, 48 R, 123/48 B, 78 F, 197 AB, 197 AC

[56] References Cited

U.S. PATENT DOCUMENTS

| | | | |
|---|---|---|---|
| 887,633 | 5/1908 | Heginbottom et al. | 123/48 B |
| 1,532,788 | 4/1925 | Vandervell | 123/48 C |
| 1,909,372 | 5/1933 | McCollum et al. | 123/48 B |
| 2,390,558 | 12/1945 | Schoen | 123/197 R |

FOREIGN PATENT DOCUMENTS

| | | | |
|---|---|---|---|
| 21138 | 10/1906 | United Kingdom | 123/48 B |

OTHER PUBLICATIONS

*Popular Mechanics,* Dec. 1976, p. 100; Lamm, Michael, "Engines that Shrink and Grow".

*Primary Examiner*—Ira S. Lazarus
*Assistant Examiner*—R. S. Bailey
*Attorney, Agent, or Firm*—Pennie & Edmonds

[57] ABSTRACT

An internal combustion engine comprising an engine block, a piston, a crankshaft, a lever, a piston connecting rod, and a crankshaft connecting rod. The engine block defines a cylinder chamber, and the piston is supported for reciprocating movement therein. The crankshaft is rotatably supported by the engine block and includes an eccentric portion. The lever includes first and second ends and an intermediate portion located therebetween, and the first end of the lever is pivotally connected to the engine block. The piston connecting rod includes a first end pivotally connected to the intermediate portion of the lever and a second end pivotally connected to the piston. The crankshaft connecting rod includes a first end pivotally connected to the second end of the lever and a second end pivotally connected to the eccentric portion of the crankshaft.

9 Claims, 3 Drawing Figures

Figure 1:
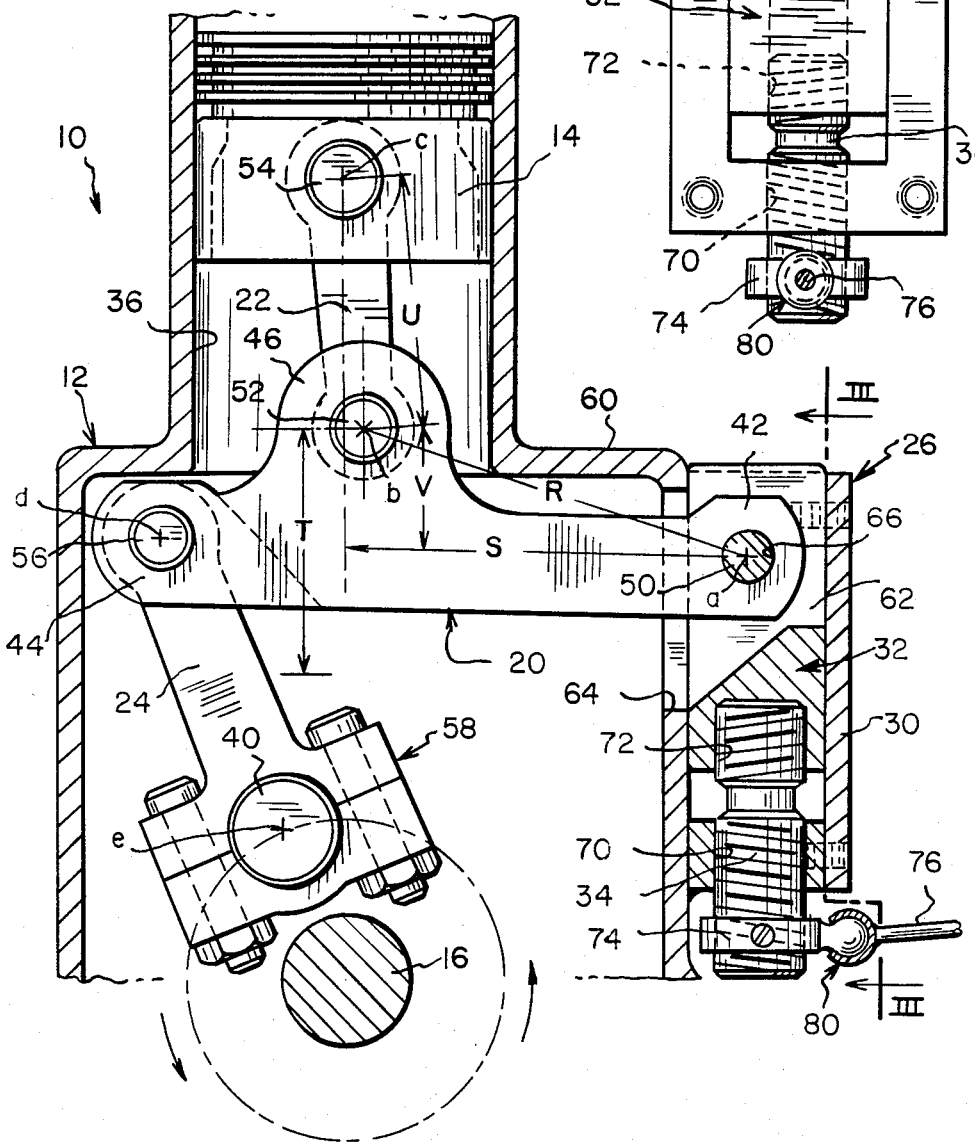

36
10
12
14
54
C
60
62
26
64
22
20
42
66
46
b
50
a
32
52
30
72
d
34
56
70
76
44
16
70
24
e
80
40
58

INTERNAL COMBUSTION ENGINE

BACKGROUND OF THE INVENTION

This invention generally relates to internal combustion engines, and more particularly to internal combustion engines especially well-suited for high fuel compression ratios.

Internal combustion engines are typically comprised of one or more cylinders each having a piston which reciprocates therein. The reciprocating motion of the piston is converted to rotary motion of a crankshaft by virtue of a connecting rod, which has a first end pivotally connected to the piston and a second end pivotally connected to an eccentric portion of the crankshaft. In operation, an explosive mixture, illustratively comprised of gasoline or oil vapors mixed with air in a predetermined ratio, is conducted into an engine cylinder, a piston is reciprocated to compress the explosive mixture in the engine cylinder, and power is obtained from this engine by igniting this mixture when the piston has fully compressed it.

Prior art engines of the general type described above have received wide commercial acceptance and are extensively used in a great variety of circumstances. Nevertheless, it is believed that these engines may be improved in several respects. To elaborate, with the above-described arrangement, forces are transmitted from the crankshaft to the piston to compress the explosive vapors in the cylinder chamber; and immediately following the ignition of these vapors, forces are transmitted from the piston to the crankshaft to rotate the crankshaft. These forces tend to have opposite affects on the crankshaft, resulting in what may be considerable internal stresses in the crankshaft. These stressses may be substantially exacerbated in multi-cylinder engines, where opposing forces may be simultaneously applied to adjacent portions of the crankshaft.

In multi-cylinder high compression ratio engines—that is, in engines where the explosive vapor in the cylinder chambers is compressed to a pressure of about 10 or 12 times its normal pressure—the internal stresses in the crankshaft are quite severe; and often, in order to withstand these stresses, the crankshafts of such engines must be constructed of special, high-strength alloys. Because these alloys are specifically developed for this use, they tend to be fairly expensive. Consequently, the use of high compression engines has been avoided in many applications where engine costs are of paramount concern.

In addition, in internal combustion engines of the general type outlined above, the rods connecting the pistons with the crankshaft often swing from side to side over a relatively large arc as the engine pistons reciprocate within the engine cylinders. This swinging movement of the connecting rods urges the pistons laterally against the engine cylinder walls. This, in turn, increases the friction within the engine, reducing its efficiency and its effective work life. Furthermore, with a typical prior art internal combustion engine, it is very difficult to adjust or to vary the compression ratio of the engine. Often, this can be done only by disassembling a major portion of the engine and replacing various parts thereof. This is very time consuming and expensive and, of course, cannot be done while the engine is operating.

Various prior art internal combustion engines have been designed to alleviate one or more of the above-discussed, or other, disadvantages, especially the lateral swinging movement of the connecting rod. Many of these engines employ two rods to connect the piston to the crankshaft, with a lever connecting together these two connecting rods. Such engines, for example, are disclosed in U.S. Pat. Nos. 242,401; 939,669; 1,625,835; 1,978,058; 2,390,558; 2,493,718; and 2,659,351. It is believed that the engines disclosed in these references do not satisfactorily resolve all the difficulties outlined above, and in particular do not effectively reduce the internal stresses on the crankshafts of the engines.

A SUMMARY OF THE INVENTION

In view of the above, an object of this invention is to eliminate the need to use a high strength alloy for the crankshaft of a high compression internal combustion engine.

Another object of the present invention is to provide an internal combustion engine with a piston connecting rod having inconsiderable lateral swinging movement.

A further object of this invention is to provide a very simple and inexpensive yet reliable and effective arrangement to vary the compression ratio of an internal combustion engine.

These and other objects are obtained with an internal combustion engine comprising an engine block, a piston, a crankshaft, a lever, a piston connecting rod, and a crankshaft connecting rod. The engine block defines at least one cylinder chamber, and the piston is supported within the cylinder chamber for reciprocating movement therein. The crankshaft is rotatably supported by the engine block and includes an eccentric portion. The lever includes first and second ends and an intermediate portion located therebetween, and the first end of the lever is pivotally connected to the engine block. The piston connecting rod includes a first end pivotally connected to the intermediate portion of the lever and a second end pivotally connected to the piston. The crankshaft connecting rod includes a first end pivotally connected to the second end of the lever and a second end pivotally connected to the eccentric portion of the crankshaft.

A BRIEF DESCRIPTION OF THE DRAWINGS

Figure 3:
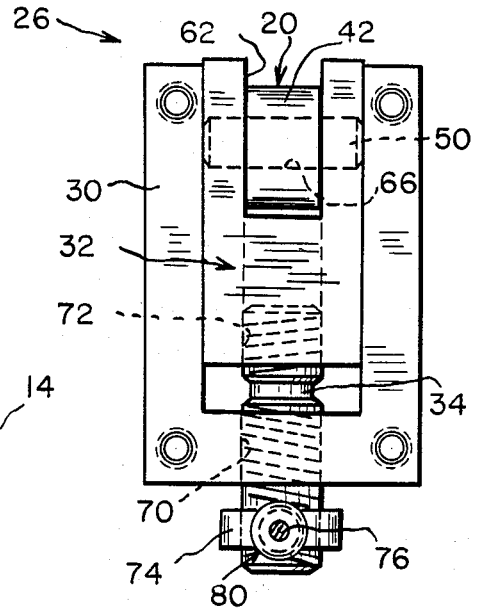
Figure 2:
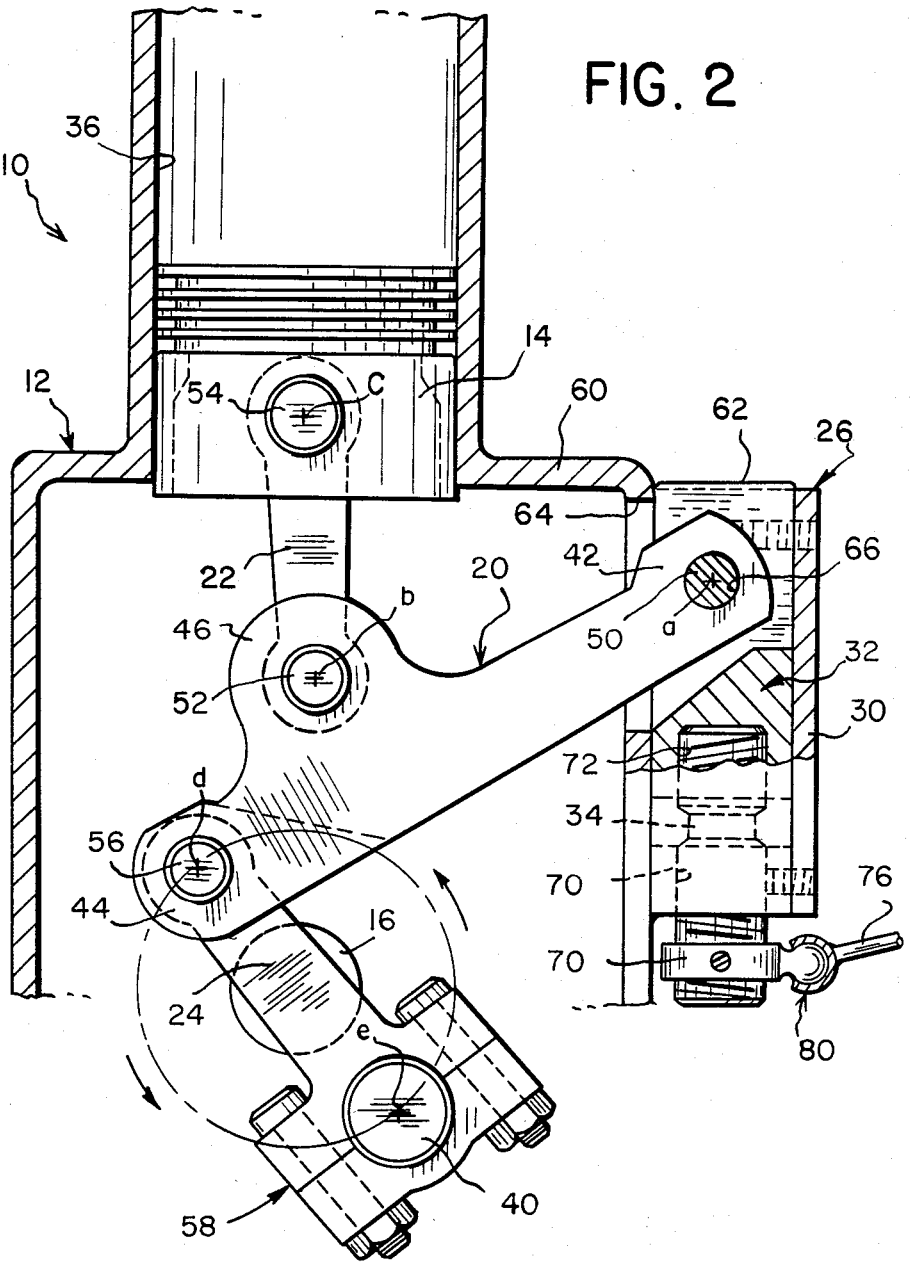

FIGS. 1 and 2 are cross-sectional views of portions of an internal combustion engine in accordance with a preferred embodiment of the present invention, with the piston of the engine shown in a top position in FIG. 1 and a bottom position in FIG. 2; and FIG. 3 is a side view taken along line III—III of FIG. 1 showing the compression ratio control of the engine.

A DETAILED DESCRIPTION OF THE PREFERRED EMBODIMENT

FIG. 1 shows a portion of internal combustion engine 10 which illustrates a preferred embodiment of the present invention. Generally, engine 10 comprises engine block 12, piston 14, crankshaft 16, lever 20, piston connecting rod 22, and crankshaft connecting rod 24. Preferably, engine block 12 includes control means 26 to vary the compression ratio of engine 10; and this control, in turn, includes housing 30, bracket 32, and adjusting means such as threaded rod 34.

More specifically, engine block 12, only a part of which is shown in the drawings, may be of any conventional type, and defines at least one cylinder chamber 36. Piston 14 is supported within cylinder chamber 36 for reciprocating movement therein. Crankshaft 16 is rotatably supported, for instance via a plurality of shaft bearings, by engine block 12, and the crankshaft includes off-center or eccentric portion 40. Lever 20 includes first and second ends 42 and 44 and an intermediate portion 46 located therebetween, and the first, or fulcrum, end of the lever is pivotally connected to engine block 12, for instance via pin 50 for pivotal movement about point "a."

Piston connecting rod 22 includes a first end pivotally connected to intermediate portion 46 of lever 20, for example by means of pin 52, for pivotal movement about point "b," and a second end pivotally connected to piston 14 by means such as pin 54 for pivotal movement about point "c." Crankshaft connecting rod 24 includes a first end pivotally connected to the second end of lever 20 by virtue of pin 56 for pivotal movement about point "d," and a second end pivotally connected to eccentric portion 40 of crankshaft 16, for instance via yoke assembly 58 for pivotal movement about point "e."

As will be appreciated by those skilled in the art, while the invention is described herein in terms of an engine having a single cylinder chamber 36 and a single piston 14, the present invention is equally applicable to engines having multiple piston cylinder chambers. In such a multi-cylinder engine, each piston 14 is preferably connected to crankshaft 16 by a separate lever 20, piston connecting rod 22, and crankshaft connecting rod 24.

In operation, crankshaft 16 rotates counterclockwise as viewed in FIGS. 1 and 2, and piston 14 reciprocates within cylinder chamber 36 in a conventional intake, compression, power, and discharge stroke cycle. That is, piston 14 moves downward within cylinder chamber 36 in an intake stroke to draw a combustible gas such as an oil-air mixture into the cylinder chamber through a conventional intake valve (not shown). As the piston next moves upward in cylinder chamber 36, the combustible gas mixture therein is compressed; and, when the piston is at or near its top position, shown in FIG. 1, in the cylinder chamber, the combustible mixture therein is ignited by means such as a spark plug (not shown). The rapidly expanding gases produced as a result of this ignition force piston 14 downward to produce the power cycle of the piston cycle. After completion of the power stroke, piston 14 moves upward within cylinder chamber 36 to force the spent vapor mixture therefrom through an exhaust valve (not shown), completing the operating cycle of the piston.

During the above-described operation of engine 10, lever 20 transmits forces between piston 14 and crankshaft 16 via piston connecting rod 22 and crankshaft connecting rod 24 to rotate the crankshaft and to drive the piston through the intake, compression, and exhaust strokes. In particular, during the power stroke of piston 14, downward movement of the piston forces piston connecting rod 22 downward, and this causes lever 20 to pivot downward about point "a." This, in turn, forces crankshaft rod 24 downward, pivoting eccentric portion 40 of crankshaft 16 around the axis of rotation thereof, and thus rotating the crankshaft itself. On the other hand, during the compression stroke of piston 14, rotation of crankshaft 16 pivots eccentric portion 40 of the crankshaft generally upward about the axis of the crankshaft. This forces crankshaft connecting rod 24 upward, causing lever 20 to pivot upward about point "a." This, in turn, forces piston connecting rod 22 upward, moving piston 24 upward in chamber 36 to compress the combustible vapors therein.

A detailed analysis of the geometric and trigonometric principles involved in the transfer of forces between piston 14 and crankshaft 16 via lever 20 is not believed necessary to an understanding of the present invention. However, it should be noted that, because piston connecting rod 22 is connected to an intermediate portion of lever 20—that is, to a portion of lever between first and second parallel lines extending through points "a" and "d", respectively, perpendicular to the line between points "a" and "d"—the lever increases forces transmitted from crankshaft 16 to piston 14 during the compression strokes of the piston and decreases forces transmitted from the piston to the crankshaft during the power strokes of the piston.

Thus, as compared to a conventional internal combustion engine where a single connecting rod is directly connected both to the piston and to the eccentric portion of the crankshaft, with the present inventon, first, a smaller force exerted by crankshaft 16 will compress the combustible mixture in cylinder chamber 36 to the same pressure, and second, the same force on piston 14, caused by the ignition of the combustible mixture in the cylinder chamber, results in a smaller force on the crankshaft. Thus, again in comparison to a conventional internal combustion engine, with the present invention, the combustible mixture in cylinder chamber 36 may be compressed to the same degree with a smaller difference between the maximum forces exerted on and by crankshaft 16, resulting in substantially reduced stresses on the crankshaft.

This is especially advantageous if engine 10 includes a plurality of cylinder chambers and a plurality of pistons, in which case the maximum forces exerted on and by crankshaft 16 may, respectively, be exerted on and by adjacent portions of the cranksahft simultaneously. In particular, this allows engine 10 to achieve high fuel compression ratios—with their associated advantages such as higher efficiencies—without the need to use a crankshaft 16 constructed from an expensive, high strength alloy.

Reducing the forces which crankshaft 16 must exert to compress the vapor within cylinder chamber 36, it should be pointed out, also reduces the effort needed to start engine 10; that is, to force piston 14 through its intake, compression, power, and exhaust cycle until the forces generated by the ignition of the combustible mixture in cylinder chamber 36 are sufficient to do this. This advantage is of particular utility if diesel fuel is used with engine 10 since typically diesel fuel, when used in such an application, is compressed in the engine cylinder chambers to sixteen or seventeen times its normal pressure.

With the specific geometry disclosed in the drawings, pivot point "d" is maintained spaced from the line defined by pivot points "b" and "c," the axis of piston connecting rod 22, as piston 14 reciprocates within cylinder chamber 36. This feature is of utility because, as a result, lever 20 exerts leverage on piston connecting rod 22 during the entire compression stroke of piston 14. Moreover, with this preferred embodiment of engine 10, crankshaft 16 rotates more than 180 degrees during movement of piston 14 from its top center position to its bottom center position and less than 180 degrees during movement of the piston from its bottom center position to its top center position.

Hence, compared to the conventional internal combustion engine where the crankshaft rotates 180 degrees both during the movement of the piston from its bottom position to its top position and during movement of the piston from its top position to its bottom position, individual intake and power strokes of piston 14 of the engine of the present invention last for a longer period of time, individual compression and exhaust strokes of the piston last for a shorter period of time, and piston 14 has a lower speed during the intake and power strokes and a higher speed during the compression and exhaust strokes. The longer dwell of piston 14 in the power stroke is advantageous in that it permits a longer, cleaner burning of the fuel in combustion chamber 36. The higher speed of piston 14 during the exhaust stroke is of utility because it causes the vapors in cylinder chamber 36 to attain higher velocities as those vapors are discharged therefrom; and this, in turn, allows the exhaust valve to fit against its valve seat for a longer period of time, increasing the transfer of heat between the exhaust valve and its cooler valve seat.

In addition to the foregoing, referring to FIG. 1, cylinder chamber 36 defines a central longitudinal cylinder axis, pivot points "b" and "c" define a piston connecting rod axis, and this piston connecting rod axis is maintained approximately, and preferably substantially, parallel to the cylinder axis as piston 14 reciprocates between the top and bottom positions. This reduces the lateral or swinging movement of piston connecting rod 22 as piston 14 reciprocates in chamber 36, substantially reducing the lateral thrust on the piston. This reduces the friction between the piston and the sidewalls of piston cylinder chamber 36, increasing both the efficiency and the lifespan of engine 10.

With the embodiment of engine 10 illustrated in the drawings, the piston rod axis is maintained substantially parallel to the cylinder axis by relating a multitude of elements of engine 10 in a specific manner. In particular, pivot point "c" is located on the cylinder chamber axis, and the perpendicular distance S between the cylinder axis and pivot point "a" is substantially equal to the distance R between pivot points "a" and "b." At the same time, the length T of travel of pivot point "b" as piston 14 moves between the top and bottom positions is substantially less, for example approximately one-half of, the distance S between points "a" and "b"—an arrangement that helps to keep point "b" from moving a substantial distance from the cylinder axis—and this travel length T of point "b" is substantially equal to the distance U between pivot points "b" and "c"—a relationship which helps to insure that the movement of point "b" away from the cylinder axis does not result in significant pivoting of piston connecting rod 22.

Further, with this preferred arrangement, pivot points "a" and "d" define a lever axis that is substantially perpendicular to the cylinder axis when piston 14 is in the top position; and, when the piston is in the top position, pivot point "b" is located above the lever axis a distance V substantially equal to half the length T of travel of pivot point "b" as piston 14 moves between the top and bottom positions. With these specific relationships, the piston rod axis and the cylinder axis are substantially colinear when piston 14 is midway between the top and bottom positions—an arrangement that reduces the maximum angle between these axes, since that maximum angle occurs when the piston is at the top and bottom positions. At the same time, preferably, the length of the projection of the line defined by points "a" and "b" in the above-described lever axis is twice the length of the projection on that axis of the line defined by points "b" and "d," wherein lever 20 provides a three-to-two mechanical advantage when transmitting forces from crankshaft connecting rod 24 to piston connecting rod 22, although of course other ratios may be used.

As previously mentioned, engine 10 is preferably provided with control means 26 to vary the compression ratio of the engine. This is done by changing the location of the top and bottom positions of piston 14, thus varying the ratio of the volume of space in cylinder chamber 36 above the piston when the piston is in the bottom position to the volume of space in the cylinder chamber above the piston when the piston is in the top position, and this is done by varying the location of pivot point "a." Specifically, raising point "a" increases the compression ratio of engine 10, while lowering point "a" decreases this ratio.

Discussing control means 26 in greater detail, housing 30 is rigidly secured, for example by welding, to the main body 60 of engine block 12, and bracket 32 is supported within the housing for reciprocating movement therein. Pin 50 is connected to bracket 32 and, as mentioned above, supports lever 20 for pivotal movement about pivot point "a." More particularly, the upper portion of bracket 32 defines recess 62, and pin 50 is rotatably supported by and extends between upper side wall portions of bracket 32, thus extending across recess 62. At the same time, the main portion of engine block 12 defines opening 64 adjacent recess 62, and the fulcrum end 42 of lever 20 extends through opening 64 into recess 62. The fulcrum end 42 of lever 20 defines a small aperture 66, and pin 50 extends through this aperture, in a close sliding fit with the surfaces of the lever defining aperture 66, rotatably supporting the fulcrum end of the lever.

Rod 34 is utilized to reciprocate bracket 32 within housing 30 to move pin 50 and pivot point "a." Preferably housing 30, specifically a bottom wall thereof, defines a first threaded opening 70, and bracket 32 defines a second threaded opening 72 above and aligned with opening 70. Rod 34 extends through opening 70 into opening 72, the upper portion of the rod threadably engages the latter opening, and the lower portion of the rod threadably engages the former opening. The threads of opening 70 and 72 are of opposite direction, such as right and left hand threads respectively, and of course the threads of the upper and lower portions of rod 34 are similarly of opposite direction.

In operation, rotation of rod 34 within openings 70 and 72 forces bracket 32 and pin 50 up and down within housing 30 to vary the compression ratio of engine 10. Control nut 74 may be secured, for example via a set screw to rod 34 outside of housing 30 for unitary rotation with rod 34, and link means 76 such as an elongated rod may be connected to the control nut, for example by a conventional ball and socket joint 80, so that rod 34 may be rotated from a location spaced therefrom. In particular, if engine 10 is used in a truck or automobile, elongated rod 76 may extend into the interior of the vehicle so that the operator thereof may rotate rod 34, and thus vary the compression ratio of engine 10, from within the vehicle and, it should be emphasized, while the engine is operating. It should be noted that engine 10 may be designed so that a comparatively small rotation of rod 34, for example a one-third or a one-quarter turn thereof, varies the compression ratio of the engine throughout the desired range. With this arrangement, link means 76 need not be designed to rotate rod 34 completely about the axis of the rod.

We claim:

1. An internal combustion engine comprising:

an engine block defining at least one cylinder chamber;

a piston supported within the cylinder chamber for reciprocating movement therein between bottom and top positions;

a crankshaft rotatably supported by the engine block and including an eccentric portion;

a lever including first and second ends the first end of the lever being connected to the engine block for pivotal movement about a first pivot points;

a crankshaft connecting rod including a first end connected to the second end of the lever for pivotal movement about a second pivot point, and a second end connected to the eccentric portion of the crankshaft for pivotal movement about a third pivot point; and a piston connecting rod including a first end connected to the piston for pivotal movement about a fourth pivot point, and a second end connected to an intermediate portion of the lever, between the first and second pivot points, for pivotal movement about a fifth pivot point fixed relative to the lever;

whereby reciprocating movement of the piston pivots the intermediate portion and the second end of the lever about the first pivot point, and pivotal movement of the second end of the lever rotates the crankshaft; and whereby the crankshaft rotates more than 180° as the piston moves from the top position to the bottom position and less than 180° as the piston moves from the bottom position to the position, and the piston has a longer dwell and a slower speed during movement from the top position to the bottom position than during movement from the bottom position to the top position.

2. An internal combustion engine according to claim 1 wherein:

the piston reciprocates within the cylinder chamber between the top and bottom positions in an intake, compression, power, and exhaust stroke cycle;

the fourth and fifth pivot points define a piston rod axis; and the second pivot point is maintained spaced from the piston rod axis as the piston reciprocates within the cylinder chamber, wherein the lever exerts leverage on the piston connecting rod during the entire compression stroke of the piston.

3. An internal combustion engine according to claim 2 wherein:

the cylinder chamber defines a central, longitudinal cylinder axis; and the piston rod axis is maintained approximately parallel to the cylinder axis as the piston moves between the top and bottom positions.

4. An internal combustion engine according to claim 3 wherein:

the fourth pivot point is located on the cylinder axis:

the perpendicular distance between the cylinder axis and the first pivot point is substantially equal to the distance between the first and fifth pivot points; and the length of travel of the fifth pivot point as the piston moves between the top and bottom position is substantially equal to the distance between the fourth and fifth pivot points, and is substantially less than the distance between the first and fifth pivot points, wherein the piston rod axis is maintained substantially parallel to the cylinder axis as the piston reciprocates between the atop and bottom positions.

5. An internal combustion engine according to claim 4 wherein the rod axis and the cylinder axis are substantially colinear when the piston is midway between the top and bottom positions.

6. An internal combustion engine according to claim 5 wherein:

the first and second pivot points define a lever axis substantially perpendicular to the cylinder axis when the piston is in the top position; and when the piston is in the top position, the fifth pivot point is located above the lever axis a distance substantially equal to half the length of travel of the fifth pivot point as the piston moves between the top and bottom positions.

7. An internal combustion engine according to claim 1 wherein:

the lever is connected to the engine block for pivotal movement about a first pivot point; and the engine block includes a body and control means to vary the location of the first pivot point relative to the body of the engine block.

8. An internal combustion engine according to claim 7 wherein the control means includes:

a housing secured to the body of the engine block a bracket support within the housing for reciprocating movement therein;

pin means connected to the bracket and pivotally supporting the lever; and means for reciprocating the bracket within the housing.

9. An internal combustion engine according to claim 8 wherein:

the housing defines a first threaded opening;

the bracket defines a second threaded opening aligned with the first threaded opening; and the means for reciprocating the bracket includes a threaded rod extending through the first and into the second threaded openings.

* * * * *